US010974536B2

(12) United States Patent
Pearson et al.

(10) Patent No.: US 10,974,536 B2
(45) Date of Patent: Apr. 13, 2021

(54) LENS-LESS MICRO-OPTIC FILM

(71) Applicant: Crane & Co., Inc., Boston, MA (US)

(72) Inventors: Nicholas G. Pearson, Amherst, NH (US); Benjamin E. Bleiman, Cumming, GA (US)

(73) Assignee: Crane & Co., Inc., Boston, MA (US)

( * ) Notice: Subject to any disclaimer, the term of this patent is extended or adjusted under 35 U.S.C. 154(b) by 0 days.

(21) Appl. No.: 16/539,937

(22) Filed: Aug. 13, 2019

(65) Prior Publication Data

US 2020/0047537 A1 Feb. 13, 2020

Related U.S. Application Data

(60) Provisional application No. 62/718,136, filed on Aug. 13, 2018.

(51) Int. Cl.

| | |
|---|---|
| ***B42D 25/324*** | (2014.01) |
| ***B42D 25/351*** | (2014.01) |
| ***B42D 25/45*** | (2014.01) |
| ***B42D 25/355*** | (2014.01) |
| ***B42D 25/29*** | (2014.01) |
| *B42D 25/378* | (2014.01) |
| *B42D 25/373* | (2014.01) |
| *B42D 25/369* | (2014.01) |

(52) U.S. Cl.

CPC ..... *B42D 25/324* (2014.10); *B42D 25/29* (2014.10); *B42D 25/351* (2014.10); *B42D 25/355* (2014.10); *B42D 25/45* (2014.10); *B42D 25/369* (2014.10); *B42D 25/373* (2014.10); *B42D 25/378* (2014.10)

(58) Field of Classification Search

CPC .... B42D 25/324; B42D 25/351; B42D 25/45; B42D 25/355; B42D 25/29; B42D 25/369; B42D 25/378; B42D 25/373

USPC ..... 283/67, 70, 72, 74, 94, 98, 901

See application file for complete search history.

(56) References Cited

U.S. PATENT DOCUMENTS

| | | | | |
|---|---|---|---|---|
| 2004/0051297 | A1 | 3/2004 | Raksha et al. | |
| 2005/0180020 | A1 | 8/2005 | Steenblik et al. | |
| 2006/0263539 | A1* | 11/2006 | Argoitia | H01F 1/06 427/547 |
| 2007/0206249 | A1 | 9/2007 | Phillips et al. | |
| 2013/0063826 | A1* | 3/2013 | Hoffmuller | B44C 1/1737 359/619 |

OTHER PUBLICATIONS

ISA/US, "International Search Report and Written Opinion of the International Searching Authority," International Application No. PCT/US2019/046417, dated Nov. 21, 2019, 12 pages.

* cited by examiner

*Primary Examiner* — Justin V Lewis

(57) ABSTRACT

Optically variable security devices, including security threads, patches, labels, strips, are disclosed herein. Certain security devices according to the present disclosure utilize a lens-less construction whereby multiple icon layers are coupled to produce a synthetic image or synthetic color that has an optically variable effect. Each icon layer includes an array of high-resolution icon elements that are aligned relative to each other and spaced apart from each other to produce the desired optically variable effect. Such security devices are particularly, though not exclusively, useful for authenticating security documents.

41 Claims, 4 Drawing Sheets

LENS-LESS MICRO-OPTIC FILM

CROSS-REFERENCE TO RELATED APPLICATION(S) AND CLAIM OF PRIORITY

This application is based on and claims priority under 35 U.S.C. § 119 to U.S. Provisional Patent Application No. 62/718,136, filed Aug. 13, 2018, the disclosure of which is incorporated by reference herein in its entirety.

TECHNICAL FIELD

The present disclosure generally relates to embodiments of a security device suitable for use in authenticating (i.e., aestheticizing and/or securing) an article of value that is otherwise susceptible to being counterfeited, forged, falsified, copied and/or passed off to consumers as authentic. More particularly, the certain embodiments according to this disclosure relate to what is referred to herein as an optically variable security device (OVSD). Certain embodiments of an OVSD according to this disclosure are multi-layered and provide an optically variable effect (OVE) when the OVSD is viewed from varying points of view. The OVE preferably is a dynamic effect where a change in point of view produces a change in location, size, shape, or color of an image projected by the OVSD. OVSDs according to various embodiments of this disclosure have particular utility in authenticating articles of value such as security documents (e.g., currency documents, identification documents) and high value consumer products.

BACKGROUND

Suppliers of authentic articles (products) of value often struggle against counterfeiters who seek to use less expensive processes to produce imitations of authentic products and transfer these counterfeits, as authentic versions, to unsuspecting consumers. For example, counterfeiters often produce counterfeit security documents by using sophisticated printing and copying technologies to photocopy authentic security documents and pass the counterfeits off as authentic documents. Some consumer products do not rely on security labels for authentication, in which case counterfeiters will simply duplicate the consumer product and pass it off as authentic. However, some consumer products use security labels to authenticate their consumer products; in which case counterfeiters will have to duplicate the consumer product—including the security label.

To thwart the efforts of counterfeiters, certain manufacturers of authentic articles of value utilize security devices that display optically variable images. These devices have become useful tools in combatting counterfeits and forgeries since even the most sophisticated copying and printing technology is unable to replicate the optical variability produced by these security devices.

There are several kinds of optical security devices. For example, U.S. Pat. Nos. 7,333,268, 7,738,175, and 7,468,842 to Steenblik et al. describe one or more optical security devices that produce synthetic images when an array of image elements are viewed through an array of focusing elements. These synthetic images may demonstrate optical variability as they show a number of different optical effects (e.g., change in location, color, size, shape, number, etc.) when viewed from various points of view. Material constructions capable of presenting such effects are also described in U.S. Pat. No. 7,738,175 to Steenblik et al., U.S. Pat. No. 7,830,627 to Commander et al., U.S. Pat. No. 8,149,511 to Kaule et al.; U.S. Pat. No. 8,878,844 to Kaule et al.; U.S. Pat. No. 8,786,521 to Kaule et al.; European Patent Application No. EP2162294 to Kaule et al, and European Patent Application No. EP2164713 to Kaule.

While there are several optical security devices that are suitable for providing enhanced security and authentication to various high security or high value products, opportunities for enhancing the performance and functionality of optical security devices remain. For example, devices such as described in the above-listed references can often require multiple manufacturing processes in order to separately create the image layer and the focusing layer. This can be expensive and can introduce variability into the manufacturing process. Moreover, the optical security devices described above can require strict post-manufacture registration between the array of focusing elements and the array of icon elements, which adds increased complications to the process. Optical security devices are often lens-based systems, comprising an array of lenses as focusing elements in the focusing layer. Lenses are susceptible to soiling, which can distort or obstruct the synthetic image produced by the security device.

One alternative to the lens-based security device is disclosed in Australian Patent Application No. AU2017101291 (the "'291 application"). Disclosed therein is a device having at least two layers with a first layer including a first pattern and a second layer having a second pattern. The second layer is separated from the first layer by a distance and the second pattern includes at least one discrete region that is a scaled version of a corresponding region of the first pattern. The device allegedly produces a three dimensional visual effect when viewing the device due to moiré interference. This moiré interference effect is produced from global scaling where both the size of lines or dots and their spacing are scaled up or down in one layer relative to the other.

The device described in the '291 application has its own deficiencies. Particularly, the lines or dots are low resolution lines which are printed or embossed using conventional printing presses, such as a Simultan printing press. The lack of high resolution lines or dots limits the resolution of any image that is projected by the device. This is important where the thickness of the device is a critical part of authenticating an article of value, such as where the device is to be used in authenticating security documents (e.g., banknotes).

SUMMARY

Certain embodiments according to the present disclosure comprise one or more of the following: (i) a security device, (ii) a method of making the security device, (iii) use of the security device or a method of using the security device, (iv) an article of value comprising the security device, or (v) a product-by-process aspect comprising a security device made by a method described herein.

In one aspect, a security device is provided where, in some embodiments, the security device is an optically variable security device (OVSD) comprising (i) a first icon layer having a first array of icon elements; (ii) a second icon layer, coupled to the first icon layer, and having a second array of icon elements; wherein the icon elements of the first icon layer and the second icon layer are lines, dots or a combination thereof; and wherein the icon elements are high resolution icon elements.

In another aspect, a method of producing the OVSD is provided where, in certain embodiments, the method comprises: (i) providing an optical spacer layer; (ii) forming a first icon layer on a first side of the optical spacer layer and forming a second icon layer on a second opposing side of the optical spacer; (iii) forming an array of icon elements on or in the first icon layer and forming a second array of icon elements on or in the second icon layer; wherein the icon elements are high resolution icon elements.

In another aspect, a method of authenticating an article of value is provided where, in some embodiments, the method comprises coupling the OVSD, as described herein, to the article of value. Other technical features may be readily apparent to one skilled in the art from the following figures, descriptions, and claims.

In another aspect, an article of value is provided where, in various embodiments, the article of value comprises: (i) an OVSD as described herein; and (ii) a substrate interface, wherein the OVSD is coupled to the substrate interface. In certain embodiments according to this disclosure, the article of value is a banknote comprising: (i) a substrate layer having a first side and a second opposing side; (ii) a first icon layer having a first array of icon elements; (iii) a second icon layer having a second array of icon elements; wherein the icon elements are high resolution icon elements.

In another aspect, embodiments according to this disclosure comprise a product-by-process where, the product is an article of value according to various embodiments of this disclosure that is made by a process according to some embodiments of this disclosure.

According to various embodiments of this disclosure, an OVSD comprises: an OVSD according to one more embodiments of this disclosure and a substrate interface, wherein the OVSD is coupled to an article of value via the substrate interface. In some embodiments, the article of value is a banknote comprising (i) a substrate layer having a first side and a second opposing side; (ii) a first icon layer having a first array of icon elements partially filled with a transparent material; (iii) a second icon layer having a second array of icon elements; wherein the icon elements are high resolution icon elements which take the form of filled posts.

Embodiments according to the present disclosure will now be further described herein such that a person having ordinary skill in the art (hereinafter "PHOSITA") may be able to make and use same without having to resort to undue experimentation. As such the embodiments heretofore or hereafter described in this disclosure are not intended to limit the scope of embodiments as disclosed and claimed herein and shall be interpreted solely as exemplary embodiments provided for purposes of describing certain embodiments. It should be apparent to a PHOSITA that many more modifications and embodiments besides those explicitly described herein are possible without departing from the inventive concepts herein. In particular, the terms "comprises", "having", and "comprising" should be interpreted as referring to elements, components, or steps in a non-exclusive manner, indicating that the referenced elements, components, or steps may be present, or utilized, or combined with other elements, components, or steps that are not expressly referenced or can be combined in particular with other embodiments described herein.

In construing terms as used in the instant disclosure, it must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DEFINITIONS

Figure 1:
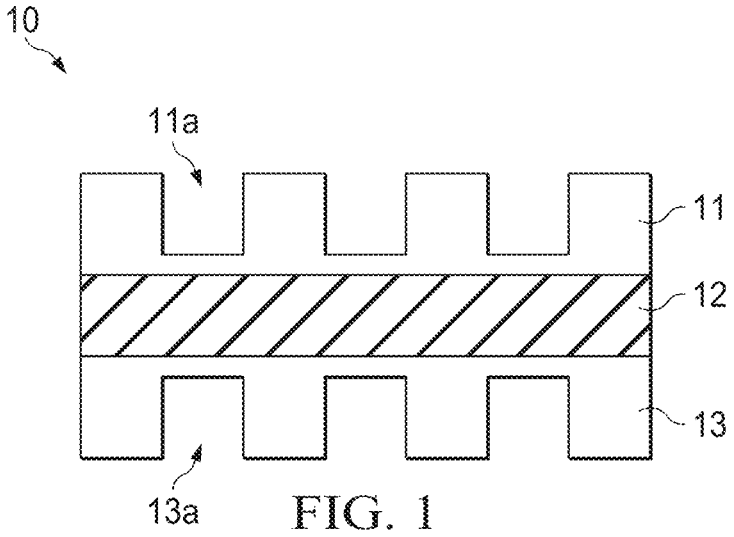
FIG. 1 illustrates a cross-section of an OVSD which provides an OVE, without having the icon elements filled or coated, according to various embodiments of this disclosure.

The term "coat" or "coating", as used herein in reference to a contrasting material, encompasses an application of a contrasting material to a void such that the contrasting material in the void occupies less than 50% of the depth of the void. According to certain embodiments, a "coat" or "coating" follows the shape of the boundaries of the void including the base and optionally the side walls. As used herein as transitive verbs, "coat" or "coating" encompass applying a coat to a post or solid region between voids.

The term "contrasting material", as used herein, encompasses a material which, when incorporated as part of the icon layers, creates a visible distinction between icon elements and the surrounding/neighboring materials.

The term "dimensional misalignment", as used herein, encompasses differences in one or more of size, shape or localized angle between icon elements of a first array of icon elements and icon elements of a second array of icon elements.

The term "fill" or "filling", as used herein in reference to a contrasting material, encompasses applying the contrasting material to a void such that the contrasting material in the void occupies 50% or greater of the depth of the void; or to printing posts with the contrasting material.

The term "high resolution", as used herein in reference to an icon element or set of icon elements, encompasses at least one of (i) lines and/or dots having widths ranging from 0.5 μm to about 6.5 μm or (ii) lines and/or dots having a spacing of less than 7.7 μm.

The term "hole", or "through-hole", as used herein in reference to a void, encompasses a structure or region of an OVSD extending from one side of a layer of the OVSD through to another side of at least that layer (e.g., first icon layer, second icon layer, or optical spacer).

The term "mesas", as used herein in reference to posts, encompasses posts which are taller (i.e., extension from their base) than they are wide.

The term "optically variable effect" or "OVE", as used herein, encompasses a display or projection of an image or set of images, such as a synthetic image, that changes in at least one of location, size, shape, or color as the optically variable security device is viewed from varying points of view.

The term "periodic misalignment", as used herein, encompasses a difference in a period of an array of icon elements present in one of the first array of icon elements relative to the second array of icon elements.

The term "plateaus", as used herein in reference to posts, encompasses a post whose base is wider than it is tall (i.e., its extension from the first icon layer or from the second icon layer).

The term "protrusion", as used herein in reference to posts, encompasses a post having sides which are unparalleled to each other or having tops that are unparalleled to their base.

The term "recess", as used herein in reference to a void, encompasses a region of an OVSD having a depth that terminates within the thickness of the layer in which it is formed.

The term "rotational misalignment", as used herein, encompasses a difference in angular orientation of the repeat pattern of one of the first array of icon elements to that of the second array of icon elements.

The term "spacing dimension", as used herein, encompasses a measurement of a region (such as a gap) between successive icon elements, such as between two lines, two dots or between a line and a dot, which form the array of icon elements or portions thereof.

The term "synthetic color", as used herein, encompasses a color or set of colors projected by an OVSD where the projected color is from an icon element or set of icon elements that have a pigment of a different color than the color(s) being projected or from an icon element(s) that have no pigment or color.

The term "synthetic image", as used herein, encompasses an image or set of images projected by an OVSD where the projected image is generated from an icon element, set of icon elements, or portions of icon elements in one icon layer that are either (i) not humanly observable without visual assistance such as from a magnifying tool, or another overlaid icon layer, or (ii) where the image provided by the icon element(s) in the one icon layer is different from the projected image, such as where portions of icon elements are combined to form the projected image.

The term "voids", as used herein, encompasses a recess or hole formed in a material layer (e.g., first icon layer, second icon layer, or optical spacer layer) of the OVSD.

The term "width dimension", as used herein, encompasses a width across an icon element, such as the width of a line or the width of a dot.

The term "zonal misalignment", as used herein, encompasses a difference in the dimensional, rotational or periodic alignment in local regions of one of the first array of icon elements relative to a second array of icon elements.

DETAILED DESCRIPTION

Heretofore there remains a need for a security device which could be prepared using a lensless system to at least avoid some of the deficiencies identified above. Moreover, there remains a need for a security device that can be produced with high resolution icon elements thereby making it much more difficult for counterfeiters to replicate while also producing higher resolution images. Still further there remains a need for a security device that could reduce the registration constraints necessary for conventional optical security devices. The inventors have surprisingly found that this objective can be advanced, at least in part, through certain embodiments according to the present disclosure.

According to various embodiments of this disclosure, an OVSD comprises a first icon layer having a first array of icon elements; a second icon layer, coupled to the first icon layer, and having a second array of icon elements. The first icon layer and the second icon layer are arranged relative to each other such that a synthetic image or synthetic color is produced when the OVSD is viewed through at least one of the first icon layer and the second icon layer.

Various types of icon elements are considered suitable embodiments of the OVSD. In some embodiments, the icon elements comprise lines (elongated) or dots or combinations thereof. Reference herein to lines or dots encompasses embodiments where the lines or dots assume are crafted into any shapes or combination of shapes. For example, the lines may form triangles, rectangles, trapezoids, rhombus, donuts, ovals, or combinations thereof, including complex shapes composed from collections of more basic shapes. The lines or dots may be arranged into preferred patterns or into preferred indicia (letters, numbers, symbols, etc.). For example, in some embodiments, the lines or dots are arranged into shapes into one of the first or second icon layer such that when viewed through the second icon layer rolling bars having an optically variable effect (OVE) are projected by the OVSD. Various exemplary OVEs will be discussed further herein.

OVSDs according to various embodiments of this disclosure employ high resolution icon elements. In certain embodiments according to this disclosure, the resolution of icon elements is finer than these conventional printing technologies. In fact, in various embodiments, the resolution is such that indicia printed with the resolution of the present icon elements are not perceivable by the naked eye. However, it has been surprisingly found that the icon elements, in at least one of the first or second icon layer, can be formed with high resolution while still being perceivable, in the form of an OVE, when viewed through the other icon layer. In certain embodiments according to this disclosure, all of the icon elements are high resolution icon elements. In certain embodiments, only some of the icon elements are high resolution icon elements, for example, in embodiments where the high and low resolution icon elements are arranged to provide a particular pattern(s). In various embodiments, icon elements of both the first icon layer and the second icon layer are high resolution icon elements. In on embodiment, icon elements in one of the first and second icon layers are high resolution. In some embodiments according to this disclosure, the icon element of at least one of the first array of icon elements and the second array of icon elements have a width (line or dot) dimension ranging from about 0.5 μm to about 6.5 μm or a spacing dimension between icon elements that is less than 7.7 μm.

In various embodiments according to this disclosure, high resolution is provided by line widths ranging from about 0.5 μm to about 6.5 μm. According to certain embodiments, the line widths are from about 0.5 μm to about 5 μm.

In various embodiments, the high resolution is provided by line spacings of less than 7.7 μm. According to some embodiments, line spacing are from about 0.5 μm to about 5.5 μm.

According to certain embodiments, high resolution is provided by dot widths ranging in size from about 0.5 μm to about 6.5 μm. In some embodiments, the dot widths are from 0.5 μm to about 5 μm.

In at least one embodiment, high resolution of the icon elements is provided by a line/dot pitch ranging from about 1.0 μm to about 6.5 μm. According to certain embodiments, line/dot pitch ranges about 1.0 μm to about 4.0 μm. Particularly, the variability of the line/dot pitch is, in some embodiments, not confined to discrete regions.

In at least one embodiment, high resolution is provided by dot spacings of less than 7.7 μm. In various embodiments, spacings are from about 0.5 μm to about 5.5 μm.

This OVSD is, in certain embodiments, a lens-less system, and as such, does not require microlenses or lenticular lenses in order to generate a synthetic image or synthetic color. Particularly, OVSD according to various embodiments of this disclosure do not require a lens system to produce a synthetic image, or synthetic color, with an OVE.

The first array of icon elements and the second array of icon elements, of the respective first and second icon layers, are, in certain embodiments according to this disclosure, disposed relative to each other such that they provide a synthetic image having an optically variable effect (OVE). For example, in some embodiments, the synthetic image with OVE produced by the OVSD includes rolling bars. In at least one embodiment, the synthetic images with OVE include multi-colored rolling bars. In various embodiments, the OVE is a color switch, whereby at least portions of the synthetic image change from one color to another as the OVSD is tilted relative to a generally static point of view (for example, a viewer's eyeball). In certain embodiments, the OVE comprises a synthetic color, which is formed as a combination of colors found in an icon layer of the OVSD. In certain embodiments according to this disclosure, the first and second icon layers are coupled such that a variable synthetic image comprising rolling bars is produced, such that when an observer's point of view (POV) changes relative to the OVSD, the rolling bars appear to move. A rolling bar OVE, according to certain embodiments of the present disclosure, of the comprises at least two sets of bars that are interleaved with each other.

In certain embodiments according to this disclosure, the OVSD provides a color switch OVE wherein a color of the synthetic image, or portions thereof, changes from one color to another as the OVSD is viewed from different angles. For example, in certain embodiments according to this disclosure, the first array of icon elements includes voids that are filled or coated with a first color (e.g., black pigment), and a second array of icon elements includes voids that are empty. Viewing the OVSD from the side proximate the second array of icon elements provides an OVE of rolling bars where this full set of bars comprise multiple sets of alternatingly arranged bars where a first set of bars has individual bars alternatingly interspersed between a second set of rolling bars. The first set of rolling bars provides a first color and the second set of bars provides a second color. As the device is tilted such that the point of view changes, the color in each set changes. As one non-limiting example, in at least one embodiment, the first set of rolling bars provides an original blue color and the second set of bars provides an original green color. As the OVSD is tilted, the original blue color in the first set of rolling bars changes to an OVE green color while the original green color changes to an OVE blue color. Of course it should be understood in the context of this application that it is not necessary for the first color to switch to the second color, the second could switch to the first as numerous color switches can be facilitated by varying the pattern of icon elements in at least one of the first icon layer and second icon layer. Although the color switch is described in relation to synthetic images comprising rolling bars, it should be understood that the synthetic image may take different patterns depending on the arrangement of the icon elements and as such the color switch may be applied to those different patterns of synthetic images as well. In at least one embodiment, the first set of rolling bars changes from blue to green. According to certain embodiments, the observed color shift provided as part of the OVE appears due to interference generated by the light transmitting through and reflecting from the thin layers of the OVSD, causing it to act as a thin-film optical filter. The various thicknesses of the material translate to different colors. As the OVSD material is tilted, the path length of the light is also changed, relative to the observer's eye, causing the wavelengths affected by the filter to change, and thus the color to change. In another embodiment, the first set of rolling bars includes a boundary bar having a boundary color. As the POV is changed, the boundary color of the boundary bar, the first set of rolling bars and the second set of rolling bars changes from a first color to a second color respectively. In certain embodiments according to this disclosure, the OVSD projects a synthetic color, where the synthetic image has a color that is distinguishable from the pigment used in filling, coating or printing the icon elements. For example, in one particular embodiment, the icon elements are filled or coated with a yellow pigment, but the synthetic image is projected with yellow and/or green colors, thereby generating a synthetic color. Other synthetic colors or color combinations can also be generated depending on the relative arrangement of the first icon layer and the second icon layer, the spacing between the layers, and the size distribution/arrangement of the icon elements.

In certain embodiments according to this disclosure, the OVSD provides a rolling bar OVE where the first array of icon elements and the second array of icon elements are coupled such that they provide sets of rolling bars. A first set of the rolling bars is alternatingly interspersed with a second set of rolling bars. As the POV of the OVSD is varied, such as through tilting, both sets of rolling bars appear to change or switch locations. It should be understood that OVEs provided by embodiments according to this disclosure are not limited to rolling bars and that the OVE produced by the changing of the point of view is not limited to movement in a particular direction. For example, a first set of synthetic images (e.g., rolling bars) may move in a first direction, while another set moves in a different direction. In certain embodiments according to this disclosure, the rolling bars move with an orthoparallactic motion (i.e., perpendicular to the direction of tilt). For example, the rolling bars can be made to go in any direction as the viewer's point of view changes. For example, in certain embodiments according to this disclosure, lines were used for one of the layers, then the material (for the purposes of design/movement) performs as a lenticular material and will only get movement along one direction of tilt. However, the relative pitch/angle of the second layer's lines can be adjusted to direct the movement of the moiré lines in many directions.

As noted, in certain embodiments according to this disclosure, the OVSD provides a synthetic color OVE. A synthetic color, as used in this disclosure, encompasses an image color that is projected from a pigmented material forming part of one of the first array of icon elements or the second array of icon elements and where the projected image color includes at least one color that is different from the color of the pigmented material found in the array of icon elements. In a preferred embodiment, the array of icon elements are filled or coated with a dark pigment that produces a first set of multi-colored bars that are green bars with yellow borders and a second set of blue bars interspersed between the first set. Adjustment of the spacing between the first icon layer and the second icon layer results in different color sets for the rolling bars and their corresponding border regions. In certain embodiments according to this disclosure, the rolling bars are not provided with a distinct border region or the border region is of the same color as the rolling bars to which they're coupled.

According to certain embodiments, Various icon elements are described in PCT/US2004/039315 to Steenblik et al., which is hereby incorporated herein by reference. It is contemplated herein that the icon elements may be voids, posts or a combination thereof. In certain embodiments according to this disclosure the voids have parallel sides such that they do not taper from either side of the layer in which they are formed. In certain embodiments according to this disclosure, the voids have non-parallel sides such that they taper from at least one side of the layer towards the other. In some embodiments, the tapering is from an outside layer towards an internal layer. The icon elements can be formed by various methods including, for example, laser patterning, photolithography, machining, embossing, printing, injection, other molding techniques, or any combination thereof. In various embodiments, the voids or posts are formed in the icon layer by applying embossing tools with a predefined pattern of void-forming elements. The icon layer is, in one or more embodiments, an uncured polymeric formulation when embossed. The icon layer is then cured and the embossing tool is removed. The voids are, in various embodiments according to this disclosure, then filled with a contrasting material, such as pigment or a reflective material (e.g., reflective metal, alloy, etc.). The term voids, as used herein, encompasses recesses and holes. Holes, according to various embodiments of this disclosure, extend through at least one layer of the OVSD, while a recess, according to some embodiments, begins and terminates within a single layer of the OVSD. The at least two icon layers may be formed simultaneously or sequentially then coupled. For example, in certain embodiments according to this disclosure, the first preliminary icon layer is layered over a second preliminary icon layer. As used in this disclosure, the term "preliminary" encompasses an indication that the icon layer is without the icon elements necessary to form a synthetic image or synthetic color. After layering the preliminary (which are, in some embodiments, polymeric) icon layers over each other to form a preliminary composite icon laminate, embossing tools are brought into contact with opposing surfaces of the composite icon laminate. It has been found that registration of the first icon layer to the second icon layer can be improved by the simultaneous embossing. Nonetheless, it is also contemplated herein that the first icon layer may be embossed before the second icon layer or vice versa. The icon elements may, in some embodiments, take various shapes of lines and dots that are themselves particular indicia and/or are arranged into patterns of indicia. The voids may be coated by various methods including, for example, electroplating, electroless plating, vapor deposition (e.g., chemical or physical vapor deposition), monomer vapor deposition, sputtering, spin coating, roll coating, other coating methods and any combination thereof.

In certain embodiments according to this disclosure, the icon elements include posts formed on or in a layer of the OVSD. In certain embodiments according to this disclosure, the posts are formed using an embossing tool or a printing tool that is capable of transferring a contrasting material to a surface of an OVSD substrate layer. In certain embodiments according to this disclosure, the posts are formed using a printing tool that provides lines or dots of high resolution. It is contemplated within the scope of the present disclosure that the posts may take various shapes. However, it has been now found that the preferred shapes are plateaus, protrusions or mesas.

Observance of the OVE or the synthetic color may take place by looking at the OVSD from either side of the OVSD; from the side proximate the first icon layer or from the side proximate the second icon layer; or from both sides of the OVSD. In certain embodiments according to this disclosure, the OVE is observable from one of the icon layer. In certain embodiments according to this disclosure, the OVE is observable from both the first icon layer and the second icon layer. It has been found useful, in polymeric banknotes, for the OVE of the OVSD to be observable from either side of the OVSD. In certain embodiments, although the synthetic image or synthetic color is observable from both side, even when only one side has filled/coated icon elements, it is preferred that the first icon layer and the second icon layer are equally filled/coated with an icon element. The synthetic image is, in some embodiments, formed from the interference provided by the icon layer that is proximate to the viewer. This interference can be provided when either or both icon layers are filled, coated, or empty or any combination thereof. For example, in certain embodiments according to this disclosure, the first icon layer, which is proximate the viewer, has icon elements that are empty voids while the second icon layer, which is distal the viewer, has icon elements that are filled voids. The alignment of the first icon layer to the second icon layer produces two sets of interspersed rolling bars that change colors as the OVSD is tilted or the observer's point of view is changed. In various embodiments, both the first icon layer and the second icon layer are provided with icon elements that are either partially filled or coated. Adjustment of the alignment and/or spacing can provide the desired OVE. Adjustment of the spacing, repeat period or patterning of the icon elements can, in some embodiments, be performed to tune the system to provide a desired OVE.

It is contemplated that, in embodiments according to this disclosure, the coupling of the first icon layer to the second icon layer may be direct or indirect. In certain embodiments according to this disclosure, the first icon layer and the second icon layer are coupled to each other such that at least one optically variable effect is provided by the OVSD when it is viewed from at least one side of the OVSD. However, in certain embodiments, additional components or layers are disposed between the first and second icon layers. While it is preferred that the first and second icon layers are directly coupled, since in such embodiments, the resulting OVSD may be thinner, in certain embodiments, a discrete optical spacer layer is disposed between the first and second icon layer. Preferably, the icon layers and the optical spacers have the same transparency or translucency and refractive index. However, in certain embodiments the icon layers and/or the spacer layer comprise distinct material formulations. It is also alternatively contemplated that the additional layer may be disposed on one or more of the exterior surfaces of the composite icon structure.

According to certain embodiments, an OVSD is constructed such that the first icon layer is comprised of filled posts and the second layer remains unfilled. In some embodiments, the sharpness and contrast of the synthetic image can be further enhanced with the addition of a transparent material that is applied so that it partially fills the spaces between the posts in the second icon layer. This material can be an additive applied at the manufacturing stage of the OVSD, it could be a transparent thread adhesive or could even be a liquid polymer applied at the papermaking stage of the process. Examples of suitable transparent materials include, without limitation polyvinyl alcohol, gelatin or polyurethanes.

According to certain embodiments, at least one of the first icon layer and the second icon layer functions as an interference layer. In at least one embodiment, the first icon layer, which is proximate to the viewer, includes icon elements that are either empty or filled to a different pattern than the second icon layer, which is distal to the viewer, includes icon elements that are posts of a contrasting material. The interference provided by the first layer provides an OVE as the OVSD is viewed from the varying points of view. As such, it should be understood that the icon elements in the first icon layer and the second icon layer, may be the same or may be different, or may be the same and filled/coated differently or the same. While in this illustrative example, the first icon layer included voids and the second icon layer included posts, the reverse is also within the scope of the present disclosure.

Suitable icon elements and methods of providing them are described in International Patent Application Publications WO2005/052650, WO2006/125224, WO2008/008635, WO2011/019912, WO2011/163298, WO/2013/028534, WO2014/143980, WO2009/017824, WO2016/044372, WO2016/011249, WO2013/163287, WO2007/133613, WO2012/103441, and WO2015/148878, WO2005/106601, WO2006/08713, which are all incorporated by reference herein in their entirety. In a preferred embodiment, the icon layers are formed using substantially transparent or clear radiation curable material including, but not limited to acrylics, polyesters, epoxies, urethanes and the like. According to various embodiments, the icon arrays are formed using acrylated urethane, such as acrylated urethane available from Lord Chemicals under the product designation U107. In certain embodiments, the icon recesses formed on the lower planar surface of the optical spacer each measure from about 0.5 to about 8 μmin depth and typically 30 μm in micro-image or icon width.

The relief structures forming the image icon elements may, depending on embodiments, be of various sizes, including micro-sized, nano-sized, macro-sized or any combination thereof. While it is contemplated that nano-sized or macro-sized would be suitable, it is preferred that the micro-sized image icon elements are used. The inventors have found that certain embodiments, utilizing micro-sized image icon elements exhibit comparatively good manufacturability.

In certain embodiments according to this disclosure, the OVSD includes an optical spacer, wherein the first icon layer and the second icon layer are integrated on opposing sides of the optical spacer. Various optical spacers, will be apparent, in view of the present disclosure, to persons having ordinary skill in the art. Accordingly, as the thickness of the optical spacer increases, changing points of view by tilting the OVSD, for example, will cause the bars, as described in certain embodiments, to appear to switch or roll faster. According to various embodiments, the OVSD has a thickness of 50 μm or less (including less than 45 μm, 40 μm, and 35 μm). It has surprisingly been found that for a thickness of less than 30 μm the OVE can still be perceived. This is particularly observable in embodiments where the OVE can be perceived from both sides of the OVSD. The interference is particularly helped by the presence of contrasting materials in both the first and second icon layers, which in turn surprisingly improves the OVE.

Similarly, in various embodiments of an OVSD according to this disclosure, additional components/layers include, without limitation, an optical spacer, a coating layer, a tie layer, a master-relief lacquer layer, a patterned metallic layer, a reflective layer, an opacifying layer, a vapor-deposited layer, a color-shifting construction layer, an anti-soiling layer, a stiffening layer or a pigmented or dyed layer. It is also contemplated that multiple arrays of micro-image elements or image icon elements are also integrated as part of the image projection system. Similarly, it is also contemplated that one or more additional icon layers are disposed between the first and second icon layer. Although it has surprisingly been found that by use of two icon layers without a lens layer it is possible to avoid the necessity of a sealing layer, it should be understood that a sealing layer is still contemplated that embodiments according to this disclosure include OVSDs wherein at least one of the first icon layer or second icon layer are being partially or fully sealed. For example, in certain embodiments the sealing layer occupies voids, particularly where the voids have empty space, while in other embodiments the sealing layer covers just the top surface of at least one of the first and second icon layer. In other embodiments, the sealing layer covers the entire OVSD.

The synthetic image projected by the OVSD, in certain embodiments, is due to the misalignment of the first array of icon elements relative to the second array of icon elements. In certain embodiments according to this disclosure, such misalignment between the two arrays produces a moiré image.

In certain embodiments according to this disclosure, the misalignment is due to at least one of dimensional misalignment, rotational misalignment, periodic misalignment or zonal misalignment. In certain embodiments according to this disclosure, the icon elements of the first icon layer are substantially uniform but vary in size relative to the icon elements of the second icon layer, thereby providing dimensional misalignment. Such dimensional misalignment may also be provided by varying the size of the icon elements across the first icon layer in a pattern that is different that the pattern of size variations present in the icon elements of the second icon layer. In certain embodiments according to this disclosure, the periodic misalignment is provided whereby the icon elements are spaced apart in a first icon layer uniformly but with a spacing that is different than the spacing provided in the second icon layer. Alternatively, the spacing of the icon elements may be in a non-uniform in the first icon layer but is the pattern is different from the spacing pattern of the icon elements of the second icon layer, thereby providing periodic misalignment. Zonal misalignment, in certain embodiments according to this disclosure, encompasses a first icon layer having icon elements present in particular zones of the first icon layer and in corresponding zones of the second icon layer are zones of icon elements having a different size, shape or spacing.

In certain embodiments according to this disclosure, the icon layer may be incorporated with a contrasting material. In at least one embodiment, the voids are filled or coated with a contrasting material. In some embodiments, some icon elements are filled while others are coated such that the array of icon elements includes both filled and coated icon elements. In certain embodiments according to this disclosure, the icon elements are voids that are coated with a contrasting material such that less than 50% of the depth of the voids are occupied by the contrasting material. Preferably the material occupies less than 45%, 40%, 35%, 30%, 25%, 20%, 15%, 10%, and 5% of the depth of the voids and takes the shape of the boundaries of the voids including the base and sidewalls. In certain embodiments according to this disclosure the icon elements are voids that are filled with a contrasting material such that 50% or more of the depth of the voids are occupied by the contrasting material. Preferably, more than 60%, 70%, 80%, 90%, 95%, 99% of the depth of the void is occupied by the contrasting material. The voids can be filled with any suitable contrasting material such as pigmented resins, inks, dyes, metals, or magnetic materials. In an exemplary embodiment, the voids are filled with a pigmented resin comprising a sub-micron pigment which is available from Sun Chemical Corporation under the product designation Spectra Pac.

In certain embodiments according to this disclosure, the posts are printed with a contrasting material or are coated with a contrasting material. Printing of the posts, as referred to herein, is meant to indicate that the posts are formed by some printing means which provides posts having high resolution or that the posts are formed as solid regions of relief structures through some high resolution embossing process. Where the posts are formed through a printing process, it is preferred that the contrasting material is included in the printing medium (e.g., ink) thereby filling the posts. Alternatively, where the posts are formed through an embossing process, it is preferred that the contrasting material is applied through a coating which coats the exposed sides of the posts.

In certain embodiments according to this disclosure, both the first and second icon layers include icon elements that are posts and/or voids. In certain embodiments according to this disclosure, one of the first array of icon elements includes posts and the second array of icon elements includes voids. The voids or posts, may be filled or coated as described above.

It has surprisingly been found certain embodiments according to the present disclosure allow the use of a high resolution icon tool for forming both the first icon layer and the second icon layer, such that when they are superimposed, an OVE is provided. It was heretofore understood that high resolution icon tools presented registration challenges for lens based systems. Surprisingly, OVSD with both high resolution icon layers according to embodiments of this disclosure provide not only improved registration but also allows the projection of synthetic images and color and OVE.

Certain embodiments according to this disclosure provide for the use of the OVSD disclosed herein to authenticate an article of value. In certain embodiments according to this disclosure, the OVSD is coupled to an article of manufacture thereby using high-resolution icon elements to provide an OVE. Coupling of the OVSD to the article of value may be by various adhesives that will be apparent, in view of the present disclosure, to a person having ordinary skill in the art. For example, suitable means of coupling the OVSD to a banknote substrate may be by heat activated or water activated adhesives. Additionally or alternatively, the OVSD may be weaved into the paper during manufacture of the banknote paper substrate, thereby being embedded fully or partially (e.g., windows). In another embodiment, the banknote substrate is polymeric wherein the OVSD is coupled to at least one side of the banknote substrate. Alternatively, in certain embodiments according to this disclosure the polymeric banknote substrate functions as an optical spacer such that the first icon layer is disposed on a first side of the substrate while the second icon layer is disposed on a second side of the substrate. In certain embodiments according to this disclosure, the OVSD functions as a polymer in window in a paper substrate. It is also contemplated that the OVSD may be coupled to other substrates besides that used for banknotes. For example, in certain embodiments according to this disclosure, the OVSD is coupled to a security label used for authenticating consumer products. The OVSD may be coupled to the label as described herein for the security documents (e.g., banknotes).

Various embodiments according to this disclosure comprise a method of producing an OVSD as disclosed herein. In certain embodiments according to this disclosure, this method comprises: providing an optical spacer layer; forming a first icon layer on a first side of the optical spacer layer, as described herein, and similarly forming a second icon layer on a second opposing side of the optical spacer; forming an array of icon elements on or in the first icon layer and forming a second array of icon elements on or in the second icon layer; wherein the icon elements are high resolution icon elements. Preferably the first and second arrays of icon elements are simultaneously formed. However, in certain embodiments according to this disclosure, where the icon elements are buried, they are sequentially formed then coupled to opposing sides of an optical spacer. The component layers (i.e., icon layers, spacer layers, etc.) are as described herein.

In certain embodiments according to this disclosure of the method, the first icon layer and the second icon layer are coupled together to produce at least one OVE, such as rolling bars, synthetic color, or color shift. The icon elements are high resolution icon elements having a width ranging from 0.6 μm to about 5.5 μm or a spacing less than about 7.7 μm.

According to some embodiments, a method of authenticating an article of value is provided where in certain embodiments according to this disclosure the method comprises coupling an OVSD to an article of value. Authenticating the article of value comprises examining the OVSD to confirm a predefined OVE.

In another aspect of the present disclosure, an article of value is provided where in certain embodiments according to this disclosure, the article of value comprises a substrate interface and an OVSD, wherein the OVSD is coupled to the substrate interface.

In another aspect, a banknote is provided where the banknote comprises: (i) a substrate layer having a first side and a second opposing side; (ii) a first icon layer having a first array of icon elements; (iii) a second icon layer having a second array of icon elements; wherein the icon elements are high resolution icon elements. The first icon layer rand the second icon layer are coupled to form a composite structure such that at least one optically variable effect is observed when the composite structure is viewed from at least one side of the composite structure. Preferably, the OVE is selected from rolling bars, synthetic color or a color shift. In certain embodiments according to this disclosure, the OVE is observable from both sides of the composite structure. In certain embodiments according to this disclosure, the substrate layer is at least one of polymeric or cellulosic material.

In certain embodiments according to this disclosure, the substrate layer is disposed between a first icon layer and a second icon layer. Alternatively, an optical spacer is disposed between the first icon layer and the second icon layer to form a composite structure that is then coupled to at least one of a first side or a second side of the substrate layer. In certain embodiments according to this disclosure, the composite structure is in the form of a surface applied, windowed or embedded patch or thread.

The OVSD described herein, will now be further described by reference to specific embodiments exemplified in the accompanying drawings.

FIG. 1 illustrates a cross-section of an OVSD which provides an OVE, without having the icon elements filled or coated, according to various embodiments of this disclosure.

Referring to the non-limiting example of FIG. 1, an OVSD 10 is shown. According to certain embodiments, OVSD 10 comprises an optical spacer 12 disposed between a first icon layer 11 and a second icon layer 13. The first icon layer 11 comprises an array of unfilled or uncoated icon elements 11*a*. In the non-limiting example of FIG. 1, icon elements 11*a* are provides as recessed lines, while the second icon layer 13 comprises an array of unfilled/uncoated icon elements 13*a* in the form of recessed dots. According to various embodiments, icon elements 11*a* and 13*a* exhibit high resolution and the first icon layer 11 and second icon layer 13 are coupled to each other and misaligned to produce an OVE.

While, in the non-limiting example of FIG. 1, the icon elements 11*a* in the first icon layer 11 comprise recessed lines and those 13*a* in the second icon layer 13 comprise recessed dots, it is also contemplated that the dots and lines could be reversed or that both icon layers 11, 13 comprise dots or lines, particularly such that the dots in discrete sections of the first icon layer 11 overlap with dots in the second icon layer 13 or that dots in the first icon layer 11 overlap with lines in the second icon layer 13 or that lines in the second icon layer 13 overlap with dots in the first icon layer 11.

In examples of manufactured OVSD according to embodiments of FIG. 1, the high resolution icon elements 11*a*, 13*a* produced an OVSD which generates an OVE without a lens array, thereby permitting the use of such OVSD as anti-counterfeiting tool. According to certain embodiments, a lens-less construction, such as illustrated in FIG. 1 enables the creation of an OVE, while simplifying the manufacturing process, and bypassing the challenges of registering icon elements with a lens structure. Further, the operational benefits of lens-less OVSD, such as illustrated by FIG. 1, include that the problems associated with soiling and damaging micro-optic lenses are avoided.

Figure 2:
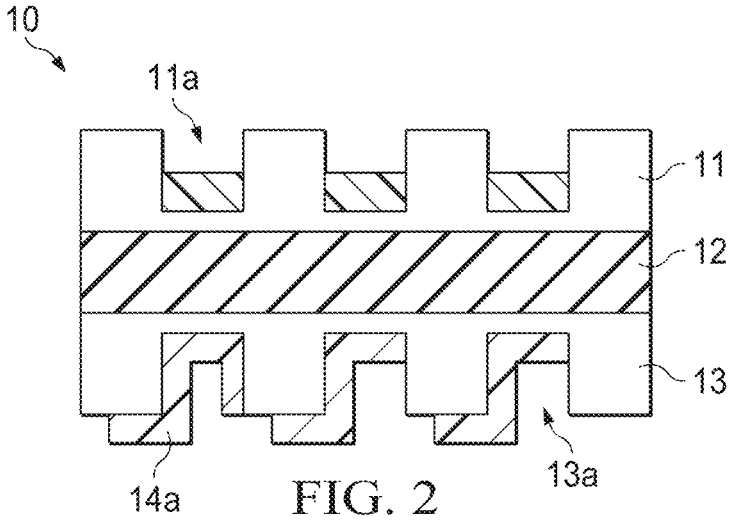
FIG. 2 illustrates a cross-section of an OVSD which provides an OVE, with icon elements of the first and second icon layers being coated, according to some embodiments of this disclosure.

FIG. 2 illustrates a cross-section of an OVSD which provides an OVE, with icon elements of the first and second icon layers being coated, according to some embodiments of this disclosure.

Referring to the non-limiting example of FIG. 2, an example of an OVSD 10 is shown. According to certain embodiments, an optical spacer 12 is disposed between a first icon layer 11 and a second icon layer 13. The first icon layer and the second icon layer 13 are, in certain embodiments, indirectly coupled and misaligned such that an OVE is projected by the OVSD. In the illustrative example of FIG. 2, the icon elements 13*a*, 11*a* are high resolution and are have a coating 14*a* in the first icon layer 11 and coated in the second icon layer 13. The coating 14*a* of the icon elements 11*a*, 13*a*, may be coated in desired patterns, such as by coating the base of the icon elements 11*a* as in the first icon layer 11 or by coating 14*a* portions of the base of the icon elements 13*a* of the second icon layer 13 or by coating 14*a* protrusions as in the second icon layer 13.

Figure 3:
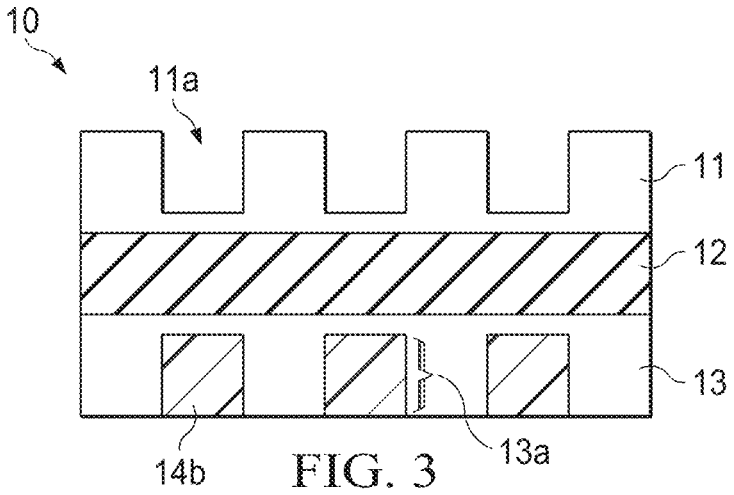
FIG. 3 illustrates a cross-section of an OVSD which provides an OVE, with icon elements of the second icon layer being filled, according to certain embodiments of this disclosure.

FIG. 3 illustrates a cross-section of an OVSD which provides an OVE, with icon elements of the second icon layer being filled, according to certain embodiments of this disclosure.

Referring to the non-limiting example of FIG. 3, an example of an OVSD 10 is shown. According to various embodiments, an optical spacer 12 is disposed between a first icon layer 11 and a second icon layer 13. Each icon layer 11, 13 includes portions having high resolution icon elements 13*a*. In various embodiments, the icon elements 11*a* of the first icon layer 11 and the icon elements 13*a* of the second icon layer 13 are arranged in an array such that they are rotationally misaligned. According to the illustrative example of FIG. 3, icon elements 13*a* of the second icon layer 13 are filled with a contrasting material filling 14*b*. When viewed from the side proximate the first icon layer 11, an OVE in the form of rolling bars is visible.

Figure 4:
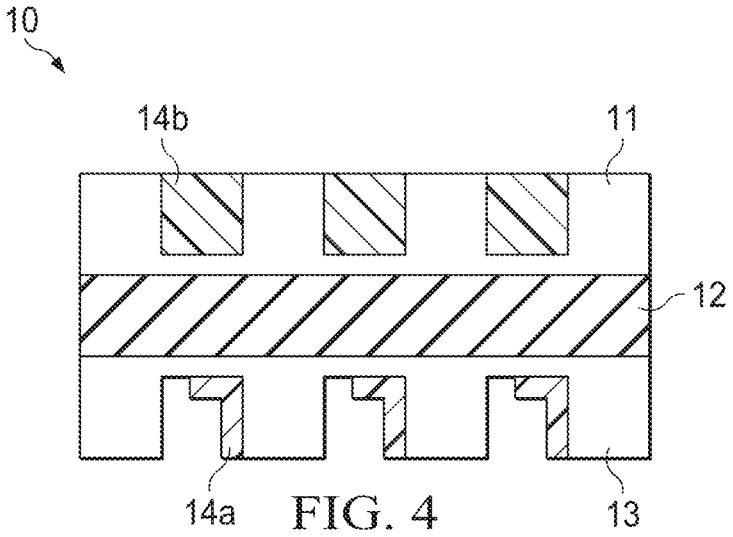
FIG. 4 illustrates a cross-section of an OVSD which provides an OVE, with icon elements of the first icon layer being filled and icon elements of the second icon layer being coated, according to some embodiments of this disclosure.

FIG. 4 illustrates a cross-section of an OVSD which provides an OVE, with icon elements of the first icon layer being filled and icon elements of the second icon layer being coated, according to some embodiments of this disclosure.

Referring to the illustrative example of FIG. 4, an example of an OVSD according to various embodiments of this disclosure is shown. According to various embodiments, an optical spacer 12 is disposed between a first icon layer 11 and a second icon layer 13. As shown in this illustrative example, an icon element 11*a* in the first icon layer 11 is filled with a contrasting material filling 14*b* while icon elements in the second icon layer 13 are coated with a contrasting material coating 14*a* in a pattern that extends along portion of the base and side of the recesses 13*a*. The first icon layer 11 and the second icon layer 13 are simultaneously formed on opposing sides of the optical spacer 12 and are misaligned to produce an OVE.

Figure 5:
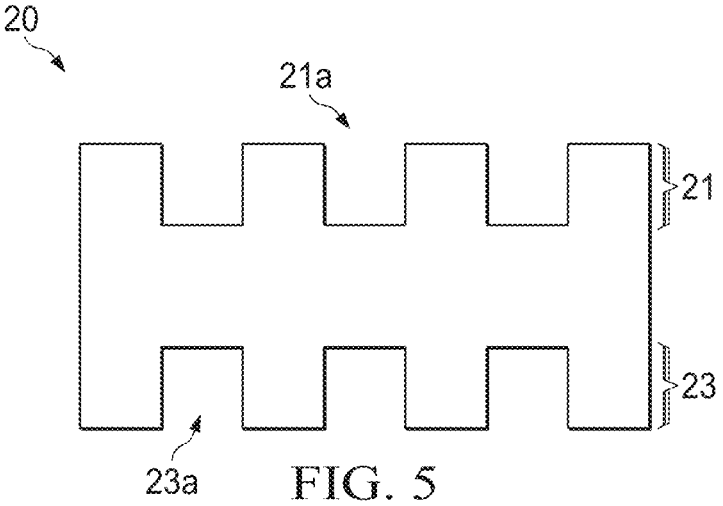
FIG. 5 illustrates a cross-section of an OVSD which provides an OVE, without a discrete optical spacer and without the icon elements being filled or coated, according to various embodiments of this disclosure.

FIG. 5 illustrates a cross-section of an OVSD which provides an OVE, without a discrete optical spacer and without the icon elements being filled or coated, according to various embodiments of this disclosure.

Referring to the non-limiting example of FIG. 5, an example of an OVSD 20 is shown. According to some embodiments, the first icon layer 21 is directly coupled to the second icon layer 23. In this illustrative example, there is no optical spacer disposed between the first icon layer 21 and the second icon layer 23. The first icon layer 21 and the second icon layer 23, each have an array of icon elements 21*a* and 23*a*, respectively. The icon elements 21*a*, 23*a* of the icon layers 21, 23 are high resolution icon elements and are misaligned to produce an OVE even though the icon elements 21*a*, 23*a* are unfilled or uncoated.

Figure 6:
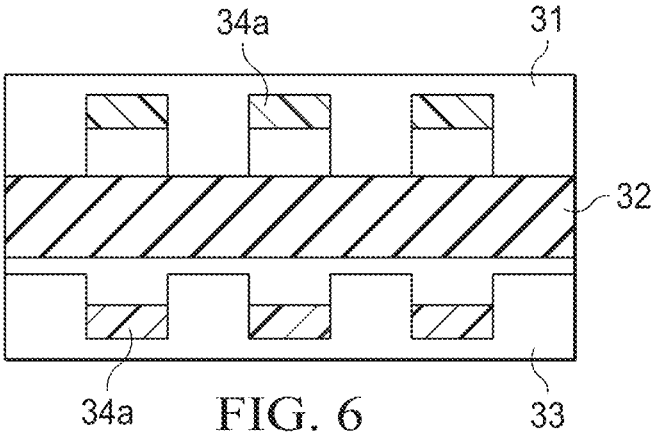
FIG. 6 illustrates a cross-section of an OVSD which provides an OVE, with the icon elements of the first and second icon layers being buried, according to certain embodiments of this disclosure.

FIG. 6 illustrates a cross-section of an OVSD which provides an OVE, with the icon elements of the first and second icon layers being buried, according to certain embodiments of this disclosure.

Referring to the non-limiting example of FIG. 6, an example of an OVSD 30 according to various embodiments of this disclosure is shown. According to some embodiments, an optical spacer 32 is disposed between a first icon layer 31 and a second icon layer 33. The first icon layer 31 and the second icon layer 33, are formed and then transferred to be coupled to opposing sides of the optical spacer 32. According to various embodiments, the high resolution recesses in the first icon layer 31 and the second icon layer 33 are buried such that their bases are set away from the optical spacer and their tops are set towards the optical spacer 32. The array of icon elements of the icon layers 31, 33 are misaligned and include high resolution icon elements 31*a*, 33*a*, respectively. As shown in the non-limiting example of FIG. 6, contrasting material is disposed as a coating 34*a*, in the recesses.

Figure 7:
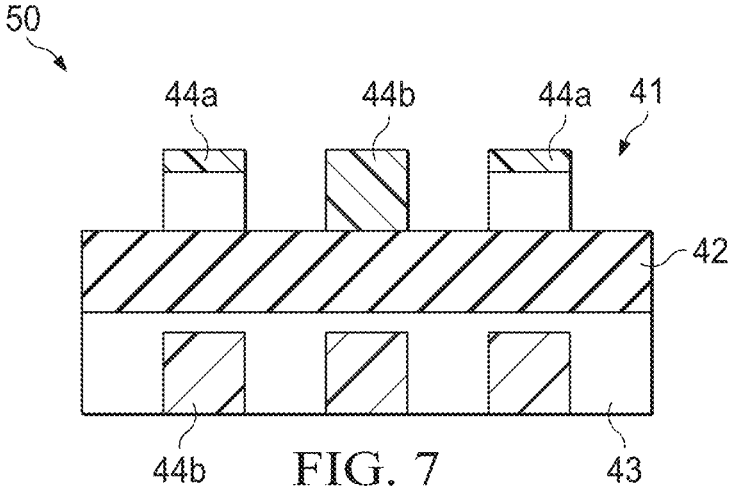
FIG. 7 illustrates a cross-section of an OVSD which provides an OVE, with icon elements of the first icon layer being posts that are coated or filled and icon elements of the second icon layer being filled voids, according to various embodiments of this disclosure.

FIG. 7 illustrates a cross-section of an OVSD which provides an OVE, with icon elements of the first icon layer being posts that are coated or filled and icon elements of the second icon layer being filled voids, according to various embodiments of this disclosure.

Referring to the non-limiting example of FIG. 7, an OVSD 40 according to various embodiments of this disclosure is shown. According to certain embodiments of OVSD 40, an optical spacer 42 is disposed between a first icon layer 41 and a second icon layer 43. As shown in this illustrative example, first icon layer 41 includes high resolution posts that are coated with a coating 44*a* and filled (for example, by printing) with a filling 44*b*. The second icon layer 43 includes high resolution recesses that filled with a filling 44*b*. The first icon layer 41 and the second icon layer 43 are misaligned to produce a synthetic color that changes as the OVSD's point of view is changed.

Figure 8:
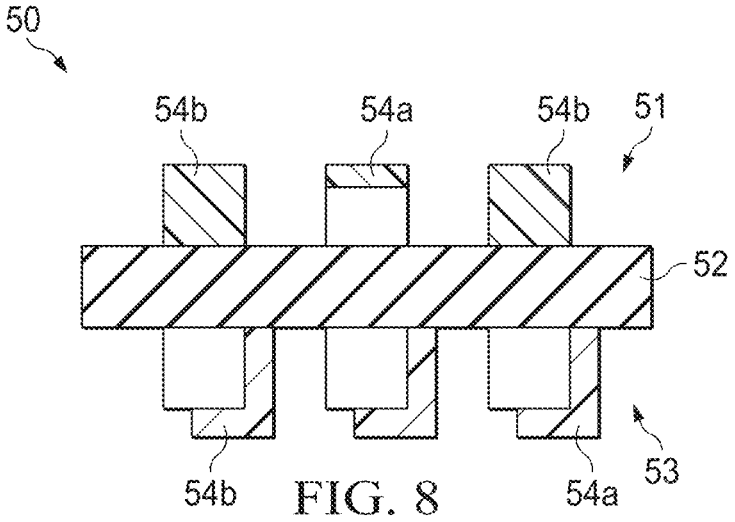
FIG. 8 illustrates a cross-section of an OVSD which provides an OVE, with icon elements of the first icon layer being posts that are coated or filled and icon elements of the second icon layer being coated posts, according to certain embodiments of this disclosure.

FIG. 8 illustrates a cross-section of an OVSD which provides an OVE, with icon elements of the first icon layer being posts that are coated or filled and icon elements of the second icon layer being coated posts, according to certain embodiments of this disclosure.

Referring to the non-limiting example of FIG. 8, an OVSD 50 is shown. According to certain embodiments, in OVSD 50, an optical spacer 52 is disposed between a first icon layer 51 and a second icon layer 53. The first icon layer 51 and the second icon layer 53, both include posts in the respective arrays of high resolution icon elements. Posts in the first icon layer include fillings (for example, material deposited through a printing process) 54*b* and coatings 54*a*, while posts in the second icon layer 53 include coatings 54*a* in a pattern that extend along the side of the posts and portions of the top. The first icon layer 51 and the second icon layer are misaligned to produce an OVE that is observable from both sides of the OVSD.

Figure 9:
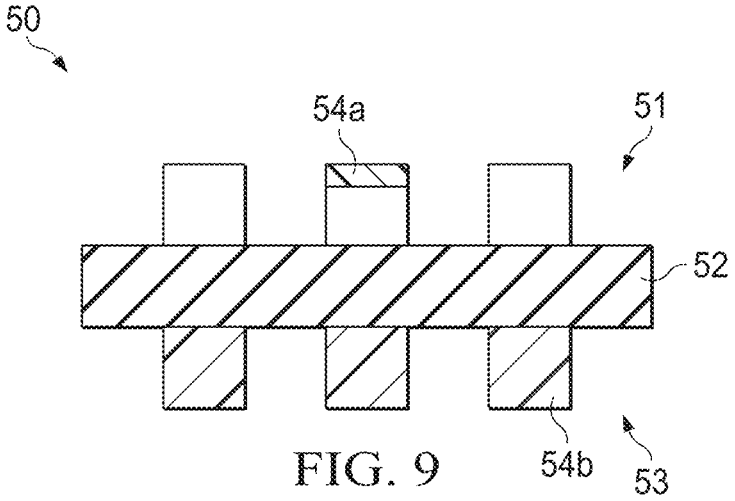
FIG. 9 illustrates a cross-section of an OVSD that provides an OVE with icon elements of the first icon layer being coated and icon elements of the second icon layer being filled posts, according to some embodiments of this disclosure.

FIG. 9 illustrates a cross-section of an OVSD that provides an OVE with icon elements of the first icon layer being coated and icon elements of the second icon layer being filled posts, according to some embodiments of this disclosure.

Referring to the non-limiting example of FIG. 9, an OVSD 50 is shown. According to various embodiments, in OVSD 50, an optical spacer 52 is disposed between a first icon layer 51 and a second icon layer 53. In this explanatory example, the first icon layer 51 and the second icon layer 53 both include posts in the respective arrays of high resolution icon elements. Posts in the first icon layer 51 include fillings 54*b* covering the sides and top of the posts, while posts in the second icon layer 53 include coatings 54*a*, which, in certain embodiments, are printed. The optical spacer 52 may be adjusted as necessary to increase the speed of the OVE. The first icon layer and the second icon layer are misaligned to produce an OVE.

Figure 10:
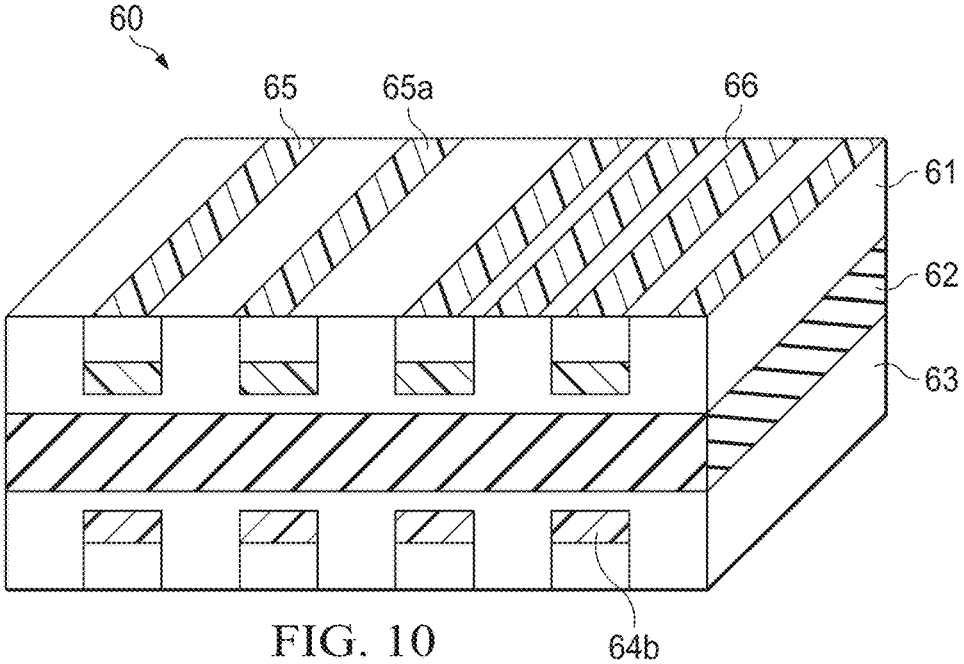
FIG. 10 illustrates an isometric cut-away view of an OVSD which includes first and second icon layers with coated icon elements and which provides an OVE in the form of rolling bars, according to certain embodiments of this disclosure.

FIG. 10 illustrates an isometric cut-away view of an OVSD which includes first and second icon layers with coated icon elements and which provides an OVE in the form of rolling bars, according to certain embodiments of this disclosure.

Referring to the non-limiting example of FIG. 10, an isometric view of an OVSD 60 is shown. According to certain embodiments, in OVSD 60, an optical spacer 62 is disposed between a first icon layer 61 and a second icon layer 63. In various embodiments, optical spacer 62 has a thickness of approximately 30 μm. As shown in this explanatory example, an array of high resolution icon elements in the first icon layer 61 and in the second icon layer 63 are coated with a contrasting material (for example, a coating) 64*b*. The first icon layer 61 and the second icon layer 63 are, in various embodiments, misaligned to produce an OVE. In the non-limiting example of FIG. 10, the OVE comprises sets of rolling bars 65, 66 which have at least one color different than that of the contrasting material. As shown in this non-limiting example, the first set of rolling bars 65 includes a border 65*a*.

Figure 11:
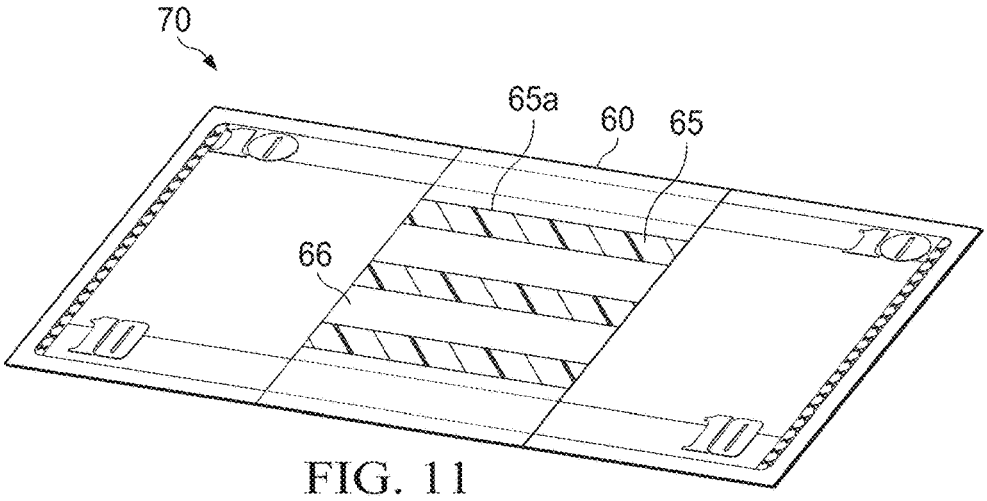
FIG. 11 illustrates an isometric cut-away view of an OVSD in a banknote with rolling bars OVE according to some embodiments of this disclosure.

FIG. 11 illustrates an isometric cut-away view of an OVSD in a banknote with a "rolling bars" OVE according to some embodiments of this disclosure.

Referring to the non-limiting example of FIG. 11, an article of value 70, which includes an OVSD 60 is shown. In this illustrative example, article of value 70 comprises a banknote. According to various embodiments, OVSD 60 provides an OVE, whose features comprise a first set of rolling bars 65 and a second set of rolling bars 66. According to various embodiments, first set of rolling bars 65 further comprises one or more visible borders 65*a*.

Figure 12:
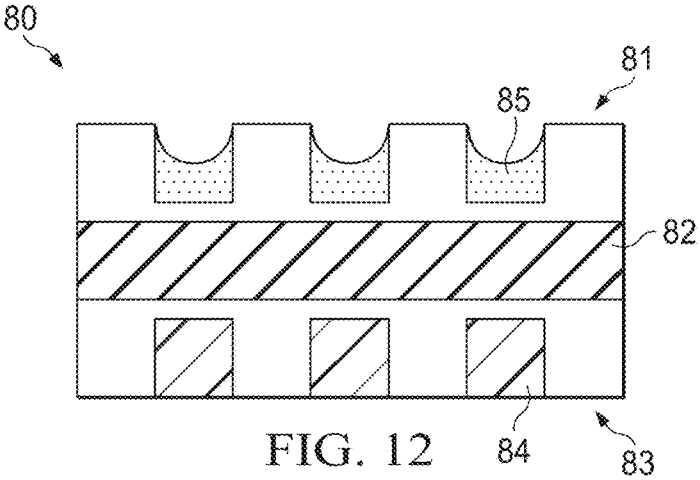
FIG. 12 illustrates a cross-section of an OVSD according to various embodiments of this disclosure, wherein the first icon layer comprises filled posts and the second icon layer is partially filled with a second, transparent material in such a way so that the regions between the posts are only partially filled.

FIG. 12 illustrates a cross-section of an OVSD according to various embodiments of this disclosure, wherein the first icon layer comprises filled posts and the second icon layer is partially filled with a second, transparent material in such a way so that the regions between the posts are only partially filled.

Referring to the non-limiting example of FIG. 12, an OVSD 80 is shown. According to various embodiments, OVSD 80 comprises a first icon layer 81 (for example, first icon layer 11 in FIG. 1), an optical spacer layer 82 (for example, optical spacer layer 12 in FIG. 1) and a second icon layer 83 (for example, icon layer 13 in FIG. 1). As shown in the non-limiting example of FIG. 12, one or more image icons of second icon layer 83 are filled with a contrasting material 84 (for example, contrasting material 14*b* in FIG. 3). Further, in some embodiments, image icons of the first icon layer 81 are partially filed with a transparent material 85, which in certain embodiments, contributes to enhancing the sharpness and contrast of an OVE provided by OVSD 80.

Examples of OVSD according to certain embodiments of this disclosure include OVSD comprising a first icon layer comprising a first array of icon elements, a second icon layer, coupled to the first icon layer, and comprising a second array of icon elements, wherein icon elements of the first icon layer and the second icon layer are lines, dots or a combination thereof, and wherein icon elements of one or more of the first icon layer or second icon layer exhibit a high resolution.

Examples of OVSD according to certain embodiments of this disclosure include OVSD wherein at least one of the first icon layer and the second icon layer is an interference layer.

Examples of OVSD according to certain embodiments of this disclosure include OVSD wherein the first icon layer and the second icon layer are coupled to each other such that at least one OVE is provided by the OVSD when icon elements in one of the first or second icon layers are viewed from at least one side of the OVSD which is proximate to the other icon layer.

Examples of OVSD according to certain embodiments of this disclosure include OVSD wherein the OVE comprises rolling bars.

Examples of OVSD according to certain embodiments of this disclosure include OVSD wherein the rolling bars are multi-colored.

Examples of OVSD according to certain embodiments of this disclosure include OVSD wherein the OVE comprises a synthetic color.

Examples of OVSD according to certain embodiments of this disclosure include OVSD wherein the OVE is observable from a first point of view, wherein the first icon layer faces a viewer and from a second point of view, wherein the second icon layer faces the viewer.

Examples of OVSD according to certain embodiments of this disclosure include OVSD further comprising transparent material partially filling a region between posts in at least one of the first icon layer or second icon layer.

Examples of OVSD according to certain embodiments of this disclosure include OVSD wherein icon elements of at least one of the first array of icon elements and the second array of icon elements have one or more of a width dimension ranging from 0.5 μm to 6.5 μm, or a spacing dimension between icon elements less than 7.7 μm.

Examples of OVSD according to certain embodiments of this disclosure include OVSD wherein icon elements of both the first array of icon elements and the second array of icon elements comprise one or more of voids or posts.

Examples of OVSD according to certain embodiments of this disclosure include OVSD wherein the voids comprise one or more of recesses or holes.

Examples of OVSD according to certain embodiments of this disclosure include OVSD wherein the posts comprise one or more of plateaus, protrusions, or mesas.

Examples of OVSD according to certain embodiments of this disclosure include OVSD wherein the high resolution comprises a line width between 0.5 μm and 5.0 μm.

Examples of OVSD according to certain embodiments of this disclosure include OVSD wherein the high resolution comprises a line spacing between 0.5 μm and 5.0 μm.

Examples of OVSD according to certain embodiments of this disclosure include OVSD wherein the high resolution comprises a dot width between 0.5 μm and 6.5 μm.

Examples of OVSD according to certain embodiments of this disclosure include OVSD wherein one or more of the first array of icon elements or second array of icon elements has a pitch between 1.0 μm and 6.5 μm.

Examples of OVSD according to certain embodiments of this disclosure include OVSD wherein the high resolution comprises a dot spacing between 0.5 μm and 5.0 μm.

Examples of OVSD according to certain embodiments of this disclosure include OVSD further comprising an optical spacer between the first icon layer and the second icon layer.

Examples of OVSD according to certain embodiments of this disclosure include OVSD wherein the first array of icon elements and the second array of icon elements are arranged to produce a misalignment between the first array of icon elements and the second array of icon elements.

Examples of OVSD according to certain embodiments of this disclosure include OVSD wherein the misalignment comprises one or more of dimensional, rotational, periodic, or zonal misalignment.

Examples of OVSD according to certain embodiments of this disclosure include OVSD wherein an OVE is produced when an observer's point of view changes relative to the OVSD.

Examples of OVSD according to certain embodiments of this disclosure include OVSD wherein icon elements of at least one of the first icon layer and the second icon layer are filled or coated with a contrasting material.

Examples of OVSD according to certain embodiments of this disclosure include OVSD wherein icon elements of at least one of the first icon layer and the second icon layer comprise posts comprising a contrasting material.

Examples of OVSD according to certain embodiments of this disclosure include OVSD wherein the icon elements in the first icon layer and the icon elements in the second icon layer are formed by an icon tool.

Examples of OVSD according to certain embodiments of this disclosure include OVSD wherein the first icon layer and the second icon layer are integrated as opposing sides of an optical spacer.

Examples of certain embodiments of this disclosure include the use of an OVSD according to this disclosure to authenticate an article of value Examples of a method of producing an OVSD according to certain embodiments of this disclosure include providing an optical spacer layer, applying a first icon layer to a first side of the optical spacer layer and applying a second icon layer to a second side of the optical spacer layer, and forming an array of icon elements on or in the first icon layer and forming a second array of icon elements on or in the second icon layer, wherein the icon elements are high resolution icon elements, and wherein the second side is opposite to the first side of the optical spacer layer.

Examples of a method of producing an OVSD according to certain embodiments of this disclosure include methods wherein the first icon layer and the second icon layer produce an optically variable effect.

Examples of a method of producing an OVSD according to certain embodiments of this disclosure include methods wherein the optically variable effect comprises one or more of rolling bars, a synthetic color, or a color shift.

Examples of a method of producing an OVSD according to certain embodiments of this disclosure include methods wherein the high resolution icon elements have a width ranging from about 0.5 μm to about 6.5 μm or a spacing less than about 7.7 μm.

Examples of a banknote according to certain embodiments of this disclosure include banknotes comprising a substrate layer having a first side and a second opposing side, a first icon layer having a first array of icon elements, a second icon layer having a second array of icon elements, wherein icon elements of the first icon layer and second icon layer are high resolution icon elements; and wherein the first icon layer and second icon layer provide an optically variable effect (OVE).

Examples of a banknote according to certain embodiments of this disclosure include banknotes wherein the first icon layer and the second icon layer are coupled to form a composite structure such that at least one optically variable effect is observed when the composite structure is viewed from at least one side of the composite structure.

Examples of a banknote according to certain embodiments of this disclosure include banknotes wherein the optically variable effect comprises one or more of a set of rolling bars, a synthetic color, or a color-shift.

Examples of a banknote according to certain embodiments of this disclosure include banknotes wherein the optically variable effect is observable from both sides.

Examples of a banknote according to certain embodiments of this disclosure include banknotes wherein the substrate layer is at least one of a polymeric or cellulosic material.

Examples of a banknote according to certain embodiments of this disclosure include banknotes wherein the substrate layer is disposed between the first icon layer and the second icon layer.

Examples of a banknote according to certain embodiments of this disclosure include banknotes wherein an optical spacer is disposed between the first icon layer and the second icon layer to form a composite structure that is coupled to at least one of a first side or a second side of the substrate layer.

Examples of a banknote according to certain embodiments of this disclosure include banknotes further comprising a surface applied, windowed or embedded patch or thread.

Although the present disclosure has been described with various embodiments, various changes and modifications may be suggested to one skilled in the art. It is intended that the present disclosure encompass such changes and modifications as falling within the scope of the appended claims.

None of the present disclosure should be read as implying that any particular element, step, or function is an essential element, step, or function that must be included in the claim scope. The scope of patented subject matter is defined only by the claims. Moreover, none of the claims are intended to invoke 35 U.S.C. § 112(f) unless the exact words "means for" are followed by a participle.

What is claimed is:

1. An optically variable security device comprising:

a substrate, the substrate comprising:

a first icon layer comprising a first array of icon elements; and a second icon layer, coupled to the first icon layer, and comprising a second array of icon elements, wherein icon elements of the first icon layer and the second icon layer are lines, dots or a combination thereof, wherein icon elements of one or more of the first icon layer or second icon layer exhibit a high resolution, wherein icon elements of the first icon layer comprise voids in a first side of the substrate and icon elements of the second icon layer comprise voids in a second side of the substrate, and wherein the first icon layer and the second icon layer provide at least one optically variable effect when one side of the optically variable security device is viewed.

2. The optically variable security device of claim 1, wherein at least one of the first icon layer and the second icon layer is an interference layer.

3. The optically variable security device of claim 1, wherein the optically variable effect comprises rolling bars.

4. The optically variable security device of claim 3, wherein the rolling bars are multi-colored.

5. The optically variable security device of claim 1, wherein the optically variable effect comprises a color switch.

6. The optically variable security device of claim 1, wherein the optically variable effect comprises a synthetic color.

7. The optically variable security device of claim 1, wherein the optically variable effect is observable from a first point of view, wherein the first icon layer faces a viewer and from a second point of view, wherein the second icon layer faces the viewer.

8. The optically variable security device of claim 1, further comprising transparent material partially filling a region between posts in at least one of the first icon layer or second icon layer.

9. The optically variable security device of claim 1, wherein icon elements of at least one of the first array of icon elements and the second array of icon elements have one or more of:

a width dimension ranging from 0.5 μm to 6.5 μm, or a spacing dimension between icon elements less than 7.7 μm.

10. The optically variable security device of claim 1, wherein icon elements of both the first array of icon elements and the second array of icon elements comprise posts.

11. The optically variable security device of claim 1, wherein the voids comprise one or more of recesses or holes.

12. The optically variable security device of claim 10, wherein the posts comprise one or more of plateaus, protrusions, or mesas.

13. The optically variable security device of claim 1, wherein the high resolution comprises a line width between 0.5 μm and 5.0 μm.

14. The optically variable security device of claim 1, wherein the high resolution comprises a line spacing between 0.5 μm and 5.0 μm.

15. The optically variable security device of claim 1, wherein the high resolution comprises a dot width between 0.5 μm and 6.5 μm.

16. The optically variable security device of claim 1, wherein one or more of the first array of icon elements or second array of icon elements has a pitch between 1.0 μm and 6.5 μm.

17. The optically variable security device of claim 1, wherein the high resolution comprises a dot spacing between 0.5 μm and 5.0 μm.

18. The optically variable security device of claim 1, further comprising an optical spacer between the first icon layer and the second icon layer.

19. The optically variable security device of claim 1, wherein the first array of icon elements and the second array of icon elements are arranged to produce a misalignment between the first array of icon elements and the second array of icon elements.

20. The optically variable security device of claim 19, wherein the misalignment comprises one or more of dimensional, rotational, periodic, or zonal misalignment.

21. The optically variable security device of claim 1, wherein the optically variable effect is produced when an observer's point of view changes relative to the optically variable security device.

22. The optically variable security device of claim 1, wherein icon elements of at least one of the first icon layer and the second icon layer are filled or coated with a contrasting material.

23. The optically variable security device of claim 1, wherein icon elements of at least one of the first icon layer and the second icon layer comprise posts comprising a contrasting material.

24. The optically variable security device of claim 1, wherein the icon elements in the first icon layer and the icon elements in the second icon layer are formed by an icon tool.

25. The optically variable security device of claim 1, wherein the first icon layer and the second icon layer are integrated as opposing sides of an optical spacer.

26. Use of the optically variable security device of claim 1 to authenticate an article of value.

27. A method of producing the optically variable security device of claim 1 comprising:

providing a substrate;

applying a first icon layer to a first side of the substrate and applying a second icon layer to a second side of the substrate; and forming an array of icon elements on or in the first icon layer and forming a second array of icon elements on or in the second icon layer, wherein the icon elements are high resolution icon elements, and wherein the second side is opposite to the first side of the substrate.

28. The method of claim 27, wherein the first icon layer and the second icon layer produce an optically variable effect.

29. The method of claim 28, wherein the optically variable effect comprises one or more of rolling bars, a synthetic color, or a color shift.

30. The method of claim 27, wherein the high resolution icon elements have a width ranging from 0.5 μm to 6.5 μm or a spacing less than 7.7 μm.

31. A method of authenticating an article of value by coupling the optically variable security device of claim 1 to the article of value.

32. An article of value comprising the optically variable security device of claim 1 and a substrate interface, wherein the optically variable security device is coupled to substrate interface.

33. The article of value of claim 31, wherein the article of value is a banknote.

34. The banknote of claim 33, wherein the first icon layer and the second icon layer are coupled to form a composite structure such that the optically variable effect is observed when the composite structure is viewed from at least one side of the composite structure.

35. The banknote of claim 33, wherein the optically variable effect comprises one or more of a set of rolling bars, a synthetic color, or a color-shift.

36. The banknote of claim 33, further comprising one or more of a surface applied, windowed or embedded patch or thread.

37. A banknote comprising:

a substrate layer having a first side and a second opposing side;

a first icon layer having a first array of icon elements; and a second icon layer having a second array of icon elements, wherein icon elements of the first icon layer and second icon layer are high resolution icon elements, wherein the first icon layer and second icon layer provide an optically variable effect, and wherein icon elements of the first icon layer and second icon layer comprise voids.

38. The banknote of claim 37, wherein the optically variable effect is observable from both sides of the banknote.

39. The banknote of claim 37, wherein the substrate layer is at least one of a polymeric or cellulosic material.

40. The banknote of claim 37, wherein the substrate layer is disposed between the first icon layer and the second icon layer.

41. The banknote of claim 37, wherein an optical spacer is disposed between the first icon layer and the second icon layer to form a composite structure that is coupled to at least one of a first side or a second side of the substrate layer.

* * * * *